United States Patent [19]

Lalikos et al.

[11] 4,092,897

[45] June 6, 1978

[54] APPARATUS FOR WEAVING BRAIDED-WIRE SHEATHING INCLUDING MEANS FOR TWISTING BUNDLED STRANDS TO EQUALIZE TENSION

[75] Inventors: James M. Lalikos, Springfield; Harold K. Waite, East Longmeadow, both of Mass.

[73] Assignee: Titeflex, a division of Atlas Corporation, Springfield, Mass.

[21] Appl. No.: 676,940

[22] Filed: Apr. 14, 1976

[51] Int. Cl.[2] ..... D04C 3/12; D04C 3/40; F16L 11/02

[52] U.S. Cl. ..... 87/29; 87/6

[58] Field of Search ..... 87/6, 7, 8, 29, 30, 87/44, 9, 33, 34

[56] References Cited

U.S. PATENT DOCUMENTS

| | | | |
|---|---|---|---|
| 936,728 | 10/1909 | Kress | 87/29 |
| 1,727,096 | 9/1929 | Bourn | 87/29 |
| 2,048,893 | 7/1936 | Rogers | 87/29 |
| 2,102,773 | 12/1937 | Weaver | 87/29 |
| 2,262,514 | 11/1941 | Pape | 87/29 X |
| 2,419,741 | 4/1947 | Stone | 87/29 |
| 3,463,197 | 8/1969 | Slade | 87/9 X |
| 3,892,161 | 7/1975 | Sokol | 87/29 |

*Primary Examiner*—John Petrakes

[57] ABSTRACT

Apparatus for interweaving bundles of wire strands over the surface of a tubular core to form a braided sheath. Each multi-strand bundle is wound on a supply bobbin which forms part of a bobbin-carrier. The bobbin-carriers are driven in opposing directions around the tubular core along sinuous paths as the core is drawn longitudinally with respect to the carriers. Each bundle of wire strands is passed through an elongated slot in a twisting member which, when rotated, wraps those strands under less tension about those strands under greater tension, continually equalizing length and tension among the bundled strands during the braiding operation.

9 Claims, 11 Drawing Figures

Fig. 3
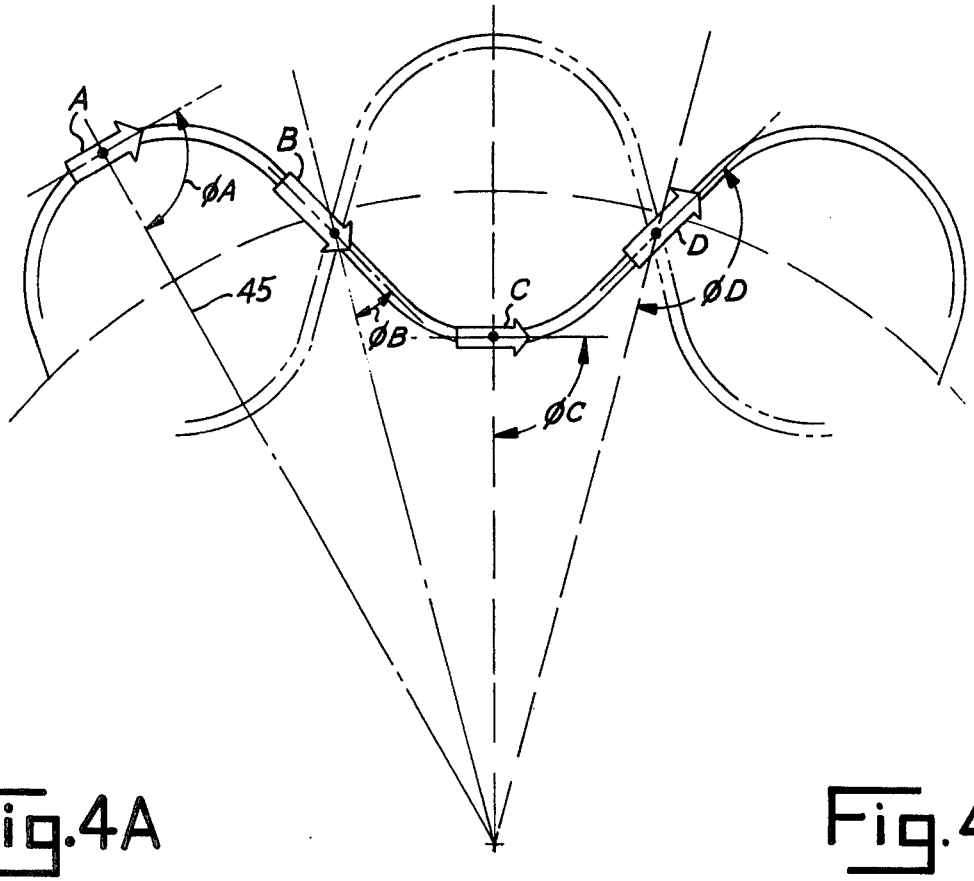
Fig. 4A
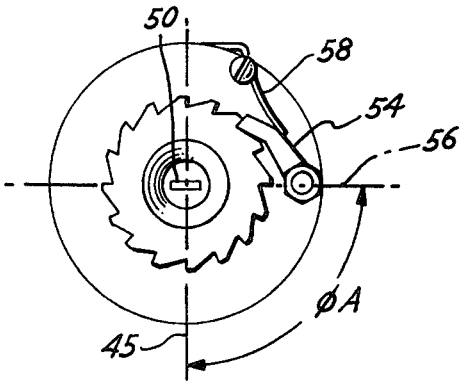
Fig. 4B
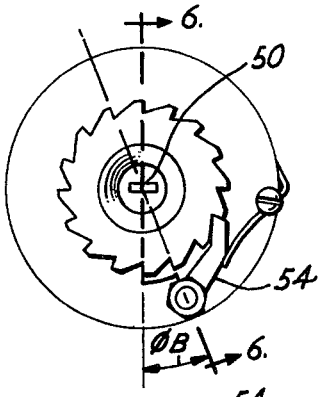
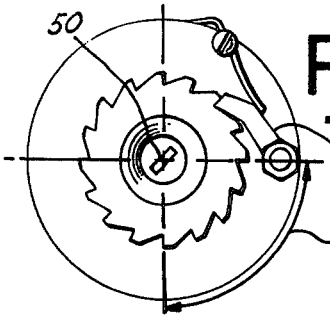
Fig. 4C
Fig. 4D
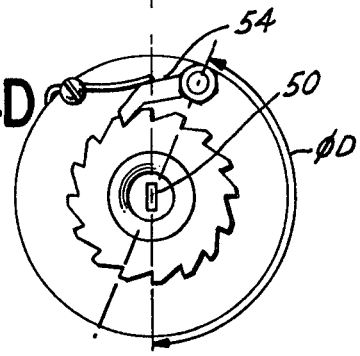

APPARATUS FOR WEAVING BRAIDED-WIRE SHEATHING INCLUDING MEANS FOR TWISTING BUNDLED STRANDS TO EQUALIZE TENSION

BACKGROUND OF THE INVENTION

This invention relates to wire braiding.

In the manufacture of a variety of products, such as shielded electrical cable and flexible hydraulic and pneumatic housing, wire is tightly woven over a tubular core to form a braided sheath. The wire strands are typically wound on supply bobbins which are driven along sinuous paths in opposing directions around the tubing, passing over and under one another to lay the wire in an interlaced woven pattern over the surface of the tubing. Each supply bobbin is mounted on a carrier which pays out the wire under controlled tension during braiding.

The wire is often wound on the bobbins, and payed out, in multi-strand bundles. Since the wire strands within each bundle are not of precisely the same length, the shorter strands are placed under greater tension during the braiding operation and stretch slightly until the lengths of the strands are equalized. When textile filaments or "soft" wire is braided, considerable elongation under tension is permissible, and tension alone works well to compensate for variations in length among the bundled strands.

However, in the construction of certain products, such as hydraulic hose, it is essential to use "hard" wires having great tensile strength. It is the strength of braided-wire sheath which permits the hose to handle high pressure without bursting. Because hard wire can be stretched very little, even under great tension, braiding tension alone does not adequately eliminate length variations, and the consequent poor distribution of load among the bundled strands significantly reduces the pressure-handling capability of the braided sheath. Moreover, such length variations greatly impede the manufacturing process itself, since excessive slack or broken strands can only be corrected by halting the braiding operation entirely.

It is accordingly the principal object of the present invention to increase the strength and endurance of braided-wire sheath while improving the efficiency of the process for manufacturing such sheath.

In accordance with the invention, the distribution of tension among the bundled strands of high-tensile-strength wire is continually equalized during braiding by passing the bundle through a twisting slot which, when rotated, wraps the slack strands, which are under lesser tension, about the remaining strands which are under greater tension. The cross-sectional area of the twisting slot is greater than the minimum cross-sectional area occupied by the bundle to permit wires under greater tension to move laterally within the bundle relative to wires under lesser tension.

According to a principal feature of the invention, the rotational force applied to the twisting slot is derived from the oscillating motion of the bobbin-carrier as it follows its sinuous course about the tubing core. The twisting slot is formed in a feeding member which is mounted for rotation on the bobbin-carrier. A unidirectional clutch mechanism, such as a ratchet and pawl, allows the feeding member to rotate more freely in one direction than in the other. As the bobbin-carrier follows its sinuous path, its orientation with respect of the direction of wire travel changes, exhibiting a partial rotation first in one direction followed by a return rotation in the other direction. In one direction, the unidirectional clutch urges the feeding member into rotation against the tendency of the twisting slot to align itself relative to the direction of wire travel. The successive incremental rotations of the slot twists the bundled strands. The twisting slot is dimensioned to allow the individual wire filaments within the bundle to realign themselves, the filaments under lesser tension naturally moving to outside of the bundled collection as it is is twisted.

BRIEF DESCRIPTION OF THE DRAWINGS

Further objects, features and advantages of the present invention may be more clearly understood through a consideration of the following detailed description and the accompanying drawings. In the drawings:

FIG. 3 is a diagram which illustrates the changing orientation of the bobbin-carrier as it follows its sinuous course around the tubing core;

FIGS. 4A–4D illustrate the manner in which the twisting slot within the feeding member is incrementally rotated by the oscillating motion of the bobbin-carrier;

DESCRIPTION OF THE PREFERRED EMBODIMENT

Figure 1:
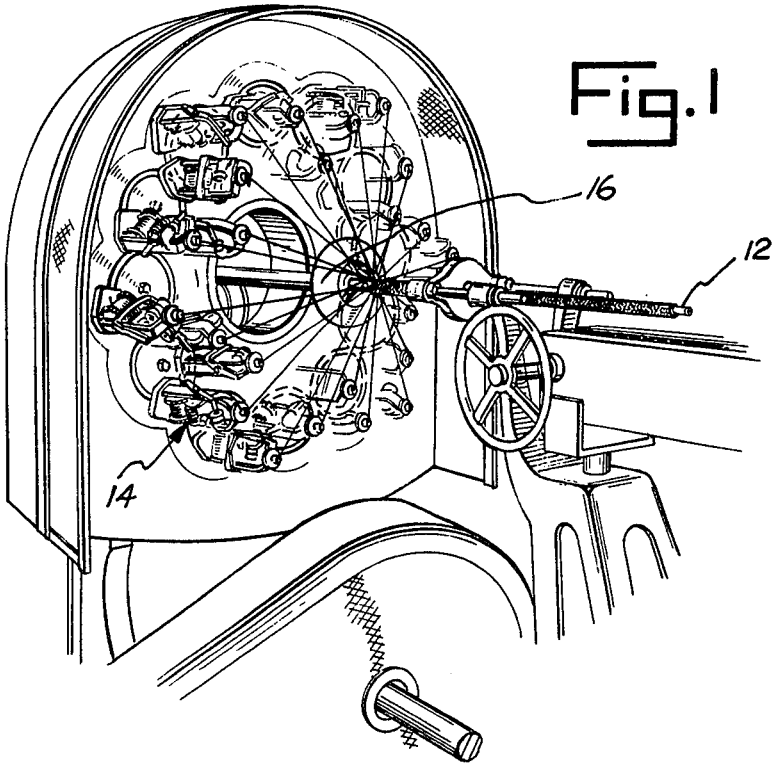
FIG. 1 is a perspective view illustrating the principal features of a conventional wire-braiding machine of the type in which the principles of the present invention may be advantageously employed.

FIG. 1 shows a conventional production machine for braiding multiple strands of wire into a woven sheath surrounding a tubular core. Braiding machines of the type shown in FIG. 1 are generally suitable for fabricating hydraulic hose. The wire is braided over the surface of an inner resilient tube, seen at 12 in FIG. 1. The braid is formed from 24 multi-strand bundles, each of which is payed-out by one of 24 bobbin-carriers, one of which is indicated generaly at 14 in FIG. 1 and shown in more detail in the perspective view of FIG. 2. Each bobbin-carrier is driven in a sinuous track, twelve of the carriers being in a first track and the remaining twelve carriers riding in a second track. The carriers in the two different tracks are driven in opposing directions. As they wind in-and-out, the tubing core 12 is drawn (by apparatus not shown) longitudinally away from the bobbin-carriers. As a result, the bundled collections of wire filaments supplied by the individual bobbin-carriers are interlaced into the desired braided pattern over the surface of the tubing core.

Each bobbin-carrier supplies wire to the braiding station under tension. Before reaching the surface of the tubing core, each bundled collection of wire (plait) bears against and is aligned by counter rotating plaits and adjacent plaits of wire as they are woven into a 2-over, 2-under braid pattern around the tube 12.

Figure 2:
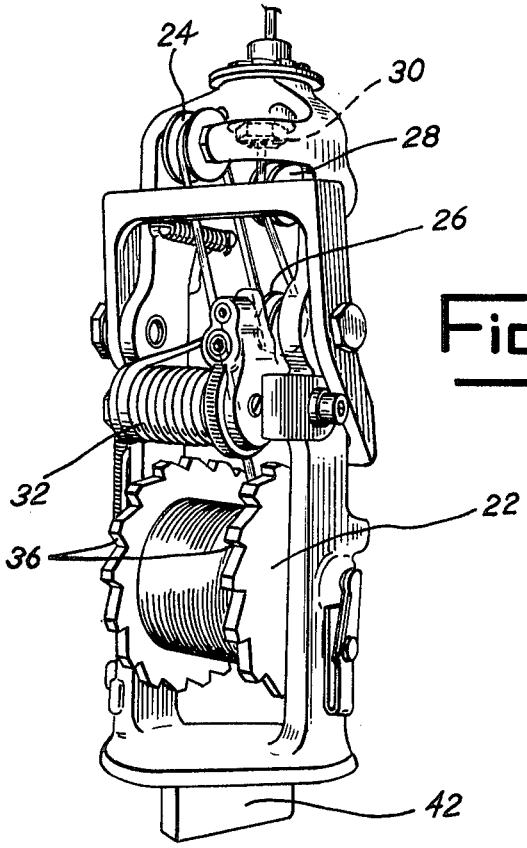
FIG. 2 is an enlarged perspective view of one of the bobbin-carrier assemblies employed in the braiding machine seen in FIG. 1.

As seen in FIG. 2, in each bobbin-carrier assembly, a supply of wire is wound on a bobbin 22. The wire from the bobbin 22 passes outwardly to a fixed roller 24, returns inwardly to pass around an idler roller 26 and again outwardly past an aligning roller 28, and finally passes outwardly through a central opening in a feeding member indicated generally at 30. A coil spring 32 urges the idler roller 26 toward the bobbin 22. When the tension on the wire bundle being payed out increases, the idler roller 26 is drawn away from the bobbin 22, releasing retaining pawls (not shown) which engage with the teeth 36 around bobbin 22. When released, bobbin 22 rotates freely paying out an additional increment of wire until the return motion of idler roller 26 re-engages the retaining pawls. In this way, the tension applied to the bundled wire strands is uniformly maintained.

The bobbin-carrier is driven along one of the sinuous tracks, seen in FIG. 1 (by drive means not shown). The bobbin is maintained in substantial alignment with the track by the tongue, a portion of which is shown at 42 in FIG. 2.

As a result of its continuous alignment with the sinuous track, each bobbin-carrier exhibits an oscillating rotational movement with respect to the direction of travel of the bundled wire being pulled toward the tube 12. This oscillating motion is illustrated in FIGS. 3 and 4 of the drawings.

FIG. 3 shows four illustrative positions (A, B, C and D) of a bobbin-carrier as it moves along its sinuous track. In position A, the carrier is at its outermost position and its direction of travel (the alignment of the long dimension of the tongue 42 seen in FIG. 2) is at a 90° angle (the angle $\phi_A$) with the line of travel 45 of the wire bundle. As the bobbin-carrier moves onward to position B, it is reoriented such that its direction of travel makes the acute angle $\phi_B$ with the line of travel of the bundled wires. At position C, the bobbin-carrier has returned to a 90° orientation with respect to the bundled wires being fed and, at position D, that orientation has increased to the obtuse angle $\phi_D$.

FIGS. 4A through D show the manner in which the rotational oscillating motion imparted to the bobbin-carrier by the curved track in which it rides is employed to rotate the feeding member 30. FIGS. 4A through D illustrate the position of the rotating feeding member 30 when the bobbin-carrier is located at positions A through D, respectively, as illustrated in FIG. 3. The relative positions and alignments of: (1) the direction of wire travel 45; (2) the twisting slot 50; and (3) the pawl 54 may be arbitrarily assumed to be as shown in FIG. 4A when the bobbin-carrier is at position A shown in FIG. 3. (Other "initial conditions" could have been chosen and would have been equally suitable for purposes of illustration.) In FIG. 4A, the long dimension of the twisting slot is at right angles to the direction of wire travel 45. Pawl 54, which is urged against the teeth of the rotatable feeding member 30 by a spring 58, pivots about a point located along the radial line 56 which makes the angle $\phi_A$ with the direction of wire travel 45. As seen in FIG. 4A, angle $\phi_A$ is initially assumed to be 90°.

Figure 6:
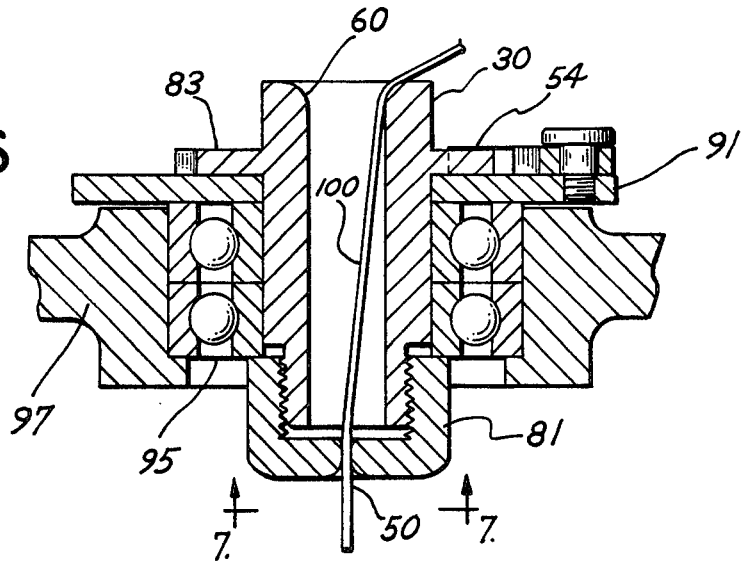
FIG. 6 is a cross-sectional view of the feeding member rotatably mounted on the bobbin-carrier.

As the bobbin-carrier moves from position A to position B, as depicted in FIG. 3, the slot 50 remains in the same perpendicular orientation with respect to the line of wire travel 45. This orientation is maintained by the pull of the bundled wires which are flattened as they pass over the outer curve of the shoulder surface 60 of the feeding member 30 (as seen in FIG. 6). As the bobbin-carrier moves from position A to position B, therefore, the position of pawl 54 is rotated in clockwise direction (compare FIGS. 4A and 4B) with respect to the feeder member 30, and the pawl 54 does not engage the teeth of the feeder member. However, in moving from position B through position C to position D, as seen in FIG. 3, the bobbin-carrier is rotated in a counterclockwise direction, the pawl 54 does engage with one of the teeth in the feeder member 30, and the twisting slot 50 is rotated counterclockwise with respect to the direction of wire travel 45. Upon passing the position shown in FIG. 4D, the counterclockwise torque, applied to the twisting member 30 by virtue of the tendency of the slot 50 to realign itself with the shoulder 60, causes the feeding member 30 to abruptly rotate an additional quarter-turn, until the slot is again aligned as initially depicted in FIG. 4A.

The cross-sectional area of the slot 50 exceeds that of the bundled collection of wires passing through it, thus allowing the wires to realign themselves or "tumble" within the slot as it rotates. Those wires within the bundled collection which are under lesser tension are hence moved to outer positions within the slot. The net effect is that the longer wires being under less tension are moved to the outside of the twisted grouping where they are helically wound around the shorter wires which are under greater tension.

Figure 5A:
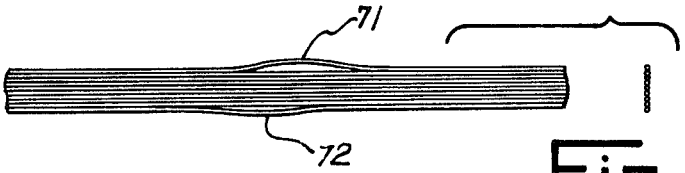
FIGS. 5A and 5B compare the substantially parallel orientation of the bundled strands produced by conventional means with the twisted configuration of the bundle produced according to the principles of the present invention.
Figure 5B:
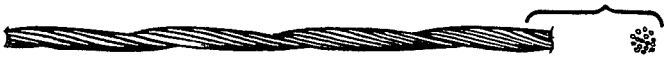

The orientation of the wires in the bundle payed out by a conventional bobbin-carrier and by a carrier incorporating the principles of the present invention are compared in FIGS. 5A and 5B. In these figures, the differences between the two have been exaggerated for purposes of illustration. FIG. 5A shows the substantially parallel wire strands supplied by a conventional bobbin-holder. FIG. 5B depicts the twisted configuration of the bundled wires produced in accordance with the present invention. As seen in FIG. 5A, longer slack strands, seen at 71 and 72, share little or none of the tension-load borne by the remainder of the wires. In contrast, the twisting action of the present invention continually compensates for variations in length between the multiple strands within the bundle by providing a longer path of travel for the longer strands.

FIG. 6 of the drawings illustrates in more detail a feeding member construction which illustrates one application of the principles of the invention. The twisting slot 50 is formed in a cap 81 which threadably engages with the hollow cylindrical body of the feeding member 30. A toothed circular flange 83 forms the toothed wheel with which the pawl 54 engages. Pawl 54 is pivotally mounted on a plate 91 which rigidly secures the bearing indicated generally at 95 to the bobbin-carrier. A multi-strand bundle of wires 100 is pulled through the twisting slot 50 and over the rounded shoulder 60.

Figure 7:
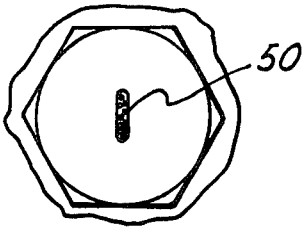
FIG. 7 is an end view of the feeding member showing the configuration of the twisting slot.

As seen in FIG. 7, the twisting slot 50 is preferably rounded at its ends to prevent individual wires from being "trapped" as they might be in the corners of a slot of a rectangular cross-section.

The amount of twisting applied to the bundle of strands may be controlled by varying the size and configuration of the twisting slot. If the slot is narrow and "tight" (that is, with a cross-sectional area only slightly larger than the area of the bundled wires — but nevertheless large enough to permit at least limited relative lateral motion of the individual wires within the bundle), the frequency of twisting will be a nearly direct function of the number of carrier oscillations per braider revolution versus the amount of wire delivered from the bobbin during that revolution. As the size, or roundness, of the slot is increased, the wires within the bundle may move more readily with respect to one another in response to the counter-torque from twisting, and each rotation of the slot puts less than a full twist in bundle.

In practice, the invention has provided substantially improved results in the manufacture of hydraulic hose. Using a 24 carrier braider, each supplying a bundle of twenty-three 0.008 inch diameter hard-drawn wire having a tensile strength of 300,000 psi, a twisting slot 0.030 inches wide and 0.160 inches long was found to produce braid having substantially improved performance characteristics. Substantial variations in the dimensions and shape of the twisting slot can be made, however, while retaining the advantages of the invention.

Unidirectional clutch mechanisms, other than the simple ratchet and pawl disclosed, can also be employed if desired. For example, the degree of twist can be increased or decreased by providing a mechanical advantage or reduction between carrier oscillation and the motion of the twisting slot. Similarly, the amount of twisting can be regulated by incorporating torque-limiting means into the ratchet mechanism.

As noted earlier, a preferred braiding pattern employs adjacent pairs of bundles woven in a "two-over, two-under" weave. By twisting the adjacent pairs in opposite directions, one clockwise and the other counterclockwise, the parallel combination is "balanced" and any tendency to produce a net twisting force to the tubing is eliminated.

The wires within the bundle need not be of the same size. An enlarged core wire may be employed, smaller "slack" wires being wrapped around the core by the twisting slot while small wires under greater tension tend to travel parallel with the core wire, thereby equalizing tension and length for improved load distribution within the bundled collection of wires.

What is claimed is:

1. In apparatus for weaving a braided wire sheath around a tubular core which comprises, in combination, a plurality of bobbin-carriers each supplying a multi-strand bundle of wires, drive means for moving said carriers in opposing directions along sinuous paths as said tubular core is drawn longitudinally whereby said bundles are interlaced in a woven pattern over the surface of said core;

the improvement comprising means for progressively twisting each of said multi-strand bundles in one direction about its length whereby strands under less tension tend to be wound helically about the strands under greater tension.

2. In apparatus for weaving a braided wire sheath around a tubular core which comprises, in combination, a plurality of bobbin-carriers each supplying a multi-strand bundle of wires, drive means for moving said carriers in opposing directions along sinuous paths as said tubular core is drawn longitudinally whereby said bundles are interlaced in a woven pattern over the surface of said core;

the improvement comprising means for twisting each of said multi-strand bundles about its length whereby strands under less tension tend to be wound helically about the strands under greater tension, wherein said means for twisting each of said bundles comprises a feeding member positioned between each of said bobbin-carriers and said tubular core, said multi-strand bundles passing through an elongated twisting slot in said feeding member and drive means for rotating said feeding member.

3. The improvement set forth in claim 2 wherein said drive means comprises unidirectional clutch means for allowing said feeding member to rotate more easily in one direction than in the opposing direction, and means to maintain said carrier in alignment with said sinuous path whereby the oscillating movement of said carriers incrementally rotates said twisting members.

4. Apparatus for fabricating high-pressure hose composed of an inner tube reinforced by an outer braided sheath woven from high tensile-strength wire which comprises, in combination:

first and second sets of bobbin-carriers, each of said bobbin-carriers paying out a multi-strand bundle of wires under tension;

drive means for moving said first set of bobbin-carriers in a first direction along a sinuous track around said inner tube and for moving said second set of bobbin-carriers in the opposing direction along a different sinuous track around said tube whereby said bundles pass alternately over and under one another to form a predetermined woven pattern over the surface of said tube;

a feeding member mounted for rotary movement on each of said bobbin-carriers, said feeding member having an elongated slot therein forming a passageway for one of said bundles; and drive means for rotating said feeding member to twist said bundle and it is fed to the surface of said inner tube.

5. The apparatus set forth in claim 4 wherein said drive means comprises a tongue on each of said carriers in engagement with the track along which it moves for placing said carriers in oscillatory rotational motion, and a unidirectional mechanism for allowing each of said feeding members to rotate, more freely in one direction than another, whereby the twisting slot is urged into unidirectional, incremental rotation.

6. Apparatus as set forth in claim 4 wherein the cross-sectional area of said slot is greater than the minimum cross-sectional area occupied by said bundle to permit wires under lesser tension to move laterally within said slot relative to wires under greater tension.

7. In an arrangement for weaving a braided wire sheath around a tubular core which comprises, in combination, a plurality of bobbin-carriers each supplying a multi-stand bundle of wires and means for interlacing said bundles in a woven pattern over the surface of said core;

the improvement comprising means positioned between each of said bobbin-carriers and said tubular core for twisting each of said multi-strand bundles bundles about its length whereby strands under less tension tend to be wound helically about the strands under greater tension.

8. The improvement set forth in claim 7 wherein said means for twisting each of said multi-strand bundles comprises a feeding member having an elongated slot therein which forms a passageway for one of said bundles, and drive means for rotating said feeding member.

9. The improvement set forth in claim 8 wherein said elongated slot has a cross-sectional area greater than the minimum cross-sectional area occupied by the bundle passing therethrough to permit strands under greater tension to move laterally within the slot relative to strands under lesser tension.

* * * * *